United States Patent [19]

Toth

[11] Patent Number: 4,621,606

[45] Date of Patent: Nov. 11, 1986

[54] AUXILIARY ARROW HOLDER APPARATUS

[76] Inventor: Dennis M. Toth, 1746 Oakwood, Trenton, Mich. 48183

[21] Appl. No.: 613,976

[22] Filed: May 25, 1984

[51] Int. Cl.[4] ..... F41B 5/00

[52] U.S. Cl. ..... 124/24 A; 124/87; 124/86; 224/916

[58] Field of Search ..... 124/41, 45, 80, 24 A, 124/23 A, 87, 86; 224/916

[56] References Cited

U.S. PATENT DOCUMENTS 3,116,730 1/1964 Tingley ..... 124/24 A
3,777,734 12/1973 Rose ..... 124/24 A
3,844,268 10/1974 Ikeya ..... 124/24 R
4,156,496 5/1979 Stinson ..... 124/23 A

*Primary Examiner*—Richard C. Pinkham
*Assistant Examiner*—Benjamin Layno
*Attorney, Agent, or Firm*—Cullen, Sloman, Cantor, Grauer, Scott & Rutherford

[57] ABSTRACT

An apparatus for holding a spare arrow on an archery bow. An arrow retaining bracket is provided on the end of an arm which extends from a mounting plate. In one embodiment the mounting plate is adapted to receive a detachable quiver. In another embodiment, a hunting sight is attached to or is formed integrally as a part of the mounting plate.

18 Claims, 9 Drawing Figures

AUXILIARY ARROW HOLDER APPARATUS

BACKGROUND OF THE INVENTION

1. Technical Field

The present invention relates to attachments to recurve and/or compound bows, and more specifically, to an attachment for retaining an extra arrow on the bow independently of a detachable bow quiver to allow a hunting archer an extra shot when the quiver is detached from the bow.

2. Description of the Prior Art

Quivers have long been used by hunters to conveniently hold extra arrows. When a qiver is attached to a bow however, the bow becomes bulky and somewhat awkward to maneuver especially if the hunter is hunting from a blind side. The quiver also adds weight to the bow making it more difficult to hunt with the bow. When a bow is shot with a full compliment of arrows held in the quiver, the force of releasing the arrow may cause the arrows to vibrate resulting in noise that can scare away the prey.

To solve the problems inherent in having a quiver attached to the bow at all times, various designs of detachable quivers have been developed. One example of such a detachable quiver is disclosed in U.S. Pat. No. 4,252,101 to Spitzke wherein six or more arrows are retained in a bow mounted quiver that may be clipped on and off the bow. The detachable quiver permits a hunter to carry a full supply of arrows and may be easily removed when the hunter is ready to shoot.

The primary disadvantage of detachable bow mounted quivers, similar to the one shown in Spitzke, is that there is no provision for a second shot if the first arrow misses the mark. To make a second shot, it is necessary for the hunter to move to where the quiver has been stored, select an arrow and relocate his prey which may permit sufficient time for the target animal to escape. The movement required to obtain the second arrow frequently permits the prey to identify the location of the hunter and escape.

Some hunters keep a loose arrow near them, for example propped against a tree, which presents certain safety hazards and in the event a hunter is not careful or slips he may injure himself on the arrow. Even with the arrow being propped near the hunter, there is significant possibility that the target animal may see the hunter's movement toward the spare arrow or that a noise will be made that would warn the target animal.

Prior art qiver mounting systems are designed to be used in conjunction with a bow sight, wherein the bow sight is attached to the bow riser first and the quiver mounting plate is attached over the bow sight mounting plate. This stacking arrangement is unstable and may cause the attachments to the bow to become loose. If the bow is to be used without the quiver and it is desirable to remove the quiver mounting plate, it is necessary to adjust the sight since the sight is generally secured to the bow riser by means of the same fasteners used to secure the bow quiver to the bow riser. While the quiver mounts may include slots for assisting in the alignment of the quiver and the sight relative to one another, the site must be realigned each time the quiver is removed from the bow.

These and other disadvantages and problems encountered with prior art bow quivers and attachments are overcome by the simple and effective auxiliary arrow holder apparatus of the present invention.

SUMMARY OF THE INVENTION

The present invention relates to providing an auxiliary arrow holder apparatus having an arrow retaining means attached to the bow independently of the detachable bow quiver which holds a single arrow in parallel spaced relationship to the bow.

The auxiliary arrow holder apparatus is adapted to be secured to an archery bow by means of a mounting plate which in one embodiment also serves as the mounting plate for a detachable quiver. The mounting plate may include means for attaching the quiver thereto which comprises a complimentary T-slot and a T-shaped extension formed on the mounting plate and the detachable quiver. Latching means are provided for holding the quiver securely on the bow and for permitting the quiver to be removed from the bow as required for hunting.

The auxiliary arrow holder apparatus of the present invention may include an arm extending from the mounting plate to an arrow support bracket wherein an arrow may be detachably retained whether or not the detachable bow quiver is attached to the bow.

It is an object of the invention to provide an improved quiver mounting system to assist the hunting archer by providing the hunter with a quiver mounting system wherein an extra arrow is retained on the bow independently of the detachable quiver. The hunter is thereby provided with a light, strong, convenient and silent apparatus for retaining a second arrow for the second shot that is ready immediately after a first shot is taken.

Another feature of the present invention is to provide a hunting sight in conjunction with the mounting plate that does not require stacking the quiver mounting plate against the sight mounting plate. The sight, according to the present invention, may be formed integrally witih the quiver mounting plate. Alternatively, the sight may be attached to the quiver mounting plate by suitable fasteners to permit the removal and re-attachment of the sight as required.

The auxiliary arrow holder of the present invention may be provided as a retrofit attachment for use with conventional detachable bow quivers. The retrofit auxiliary arrow holder apparatus preferably includes a mounting plate which is adapted to be secured to the bow riser between the bow riser and the quiver mounting plate. This arrangement permits the main quiver to be removed from its mounting plate while the auxiliary arrow holder apparatus remains attached to the bow.

While the invention will be described in connection with several preferred embodiments, it will be understood that it is not intended to limit the invention to the embodiments described. On the contrary, it is intended to cover all alternatives, modifications and equivalents as may be included within the scope of the invention as defined by the appended claims.

BRIEF DESCRIPTION OF THE DRAWINGS

Other objects and advantages of the invention will become apparent upon reading the following detailed description and upon reference to the drawings, in which.

DETAILED DESCRIPTION

Figure 1:
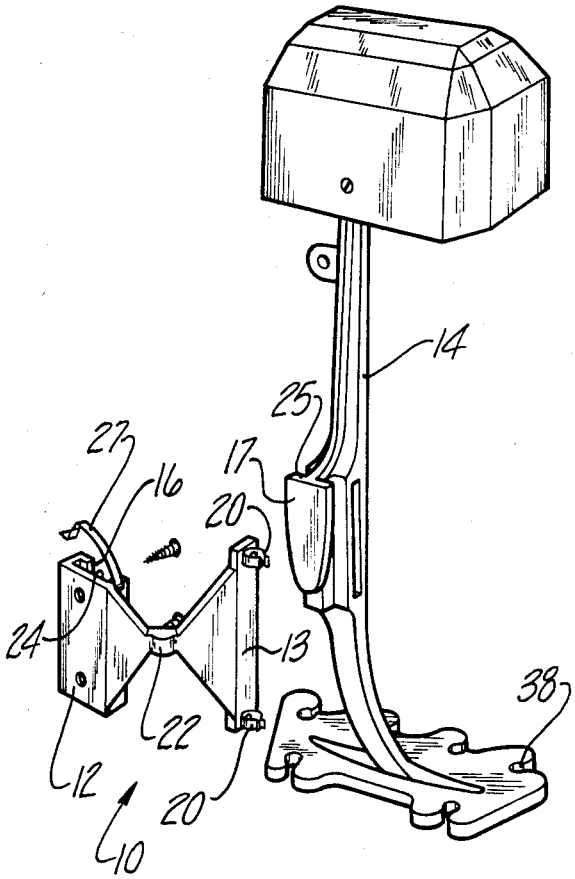
FIG. 1 is an exploded perspective view of the mounting plate including the auxiliary arrow holder apparatus and a detachable quiver.

Referring now to FIG. 1, one embodiment of the auxiliary arrow holder apparatus is generally indicated by reference numeral 10. The apparatus 10 includes a mounting plate 12 to which is attached an arrow support bracket 13. A detachable quiver 14 is preferably adapted to be attached to the mounting plate 12 by first and second means 16 and 17 formed on the mounting plate and the quiver for detachably securing the quiver 14 to the mounting plate 12. The arrow support bracket 13 includes two spring clips 20 for holding an arrow. The arrow support bracket 13 is interconnected with the mounting plate 12 by an arm 22 as will be described below.

The first and second means 16 and 17 for detachably securing the quiver 14 to the mounting plate 12 in the illustrated embodiment includes a T-slot 24 formed in the mounting plate 12 and a T-shaped extension 25 formed on the detachable quiver 14. The T-shaped extension 25 and the T-slot 24 are complementary to permit sliding movement of the quiver 14 relative to the mounting plate 12. A latch clip 27 spans the T-slot 24 to lock the T-shaped extension 25 of the quiver into the T-slot 24.

Figure 2:
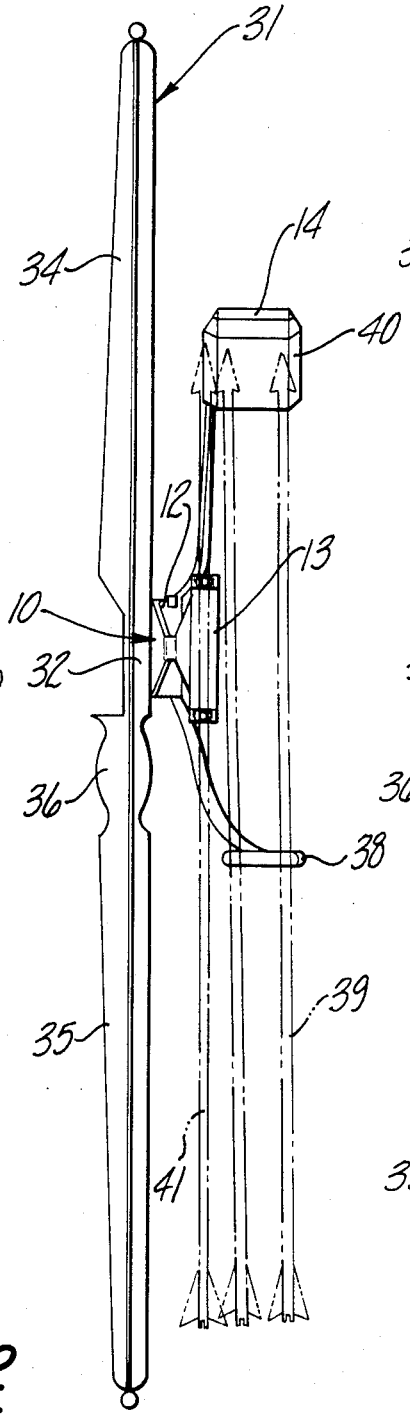
FIG. 2 is a rear elevational view of a bow having the mounting plate with the auxiliary arrow holder apparatus and a detachable quiver attached thereto.

Referring now to FIG. 2, an archery bow 31 is shown with the auxiliary arrow holder apparatus 10 and detachable quiver 14 attached thereto. The bow 31 includes a bow riser 32 such as is generally provided for attaching accessories to an archery bow. The bow riser 32 is located between the top limb 34 and bottom limb 35 of the bow 31. The bow riser 32 is located immediately above and adjacent to the handle portion 36.

Figure 3:
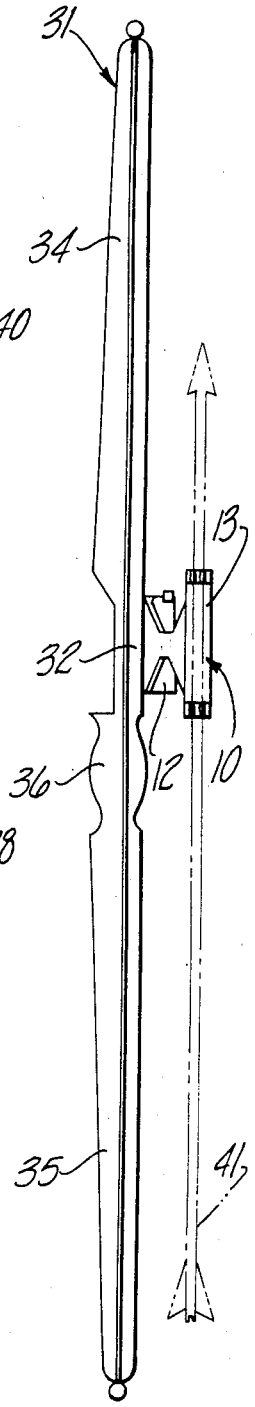
FIG. 3 is a rear elevational view of the bow having the mounting plate with the auxiliary arrow holder apparatus.

The auxiliary arrow holder apparatus and the detachable quiver 14 are made of substantially rigid plastic material such as acrylonitrile, butadiene, styrene or a high density polyethylene. The portion of the quiver 14 including a plurality of arrow retainers 38 for gripping a plurality of arrows 39 as they are stored in the quiver 14 is preferably made of a softer plastic such as polyurethane. A shield 40 is preferably provided to substantially enclose the arrow heads of the arrows 39. The single arrow 41 is shown disposed in the arrow support bracket 13 in FIG. 2 as it appears when the quiver 14 is attached to the mounting plate 12. In FIG. 3 the single arrow 41 is shown as it appears when the quiver 14 is detached from the mounting plate 12.

Figure 4:
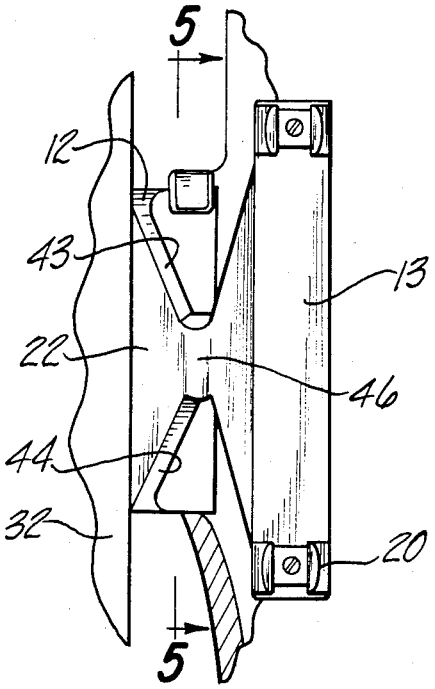
FIG. 4 is a fragmentary rear elevational view of the bow riser, detachable quiver and mounting plate with the auxiliary arrow holder apparatus.
Figure 6:
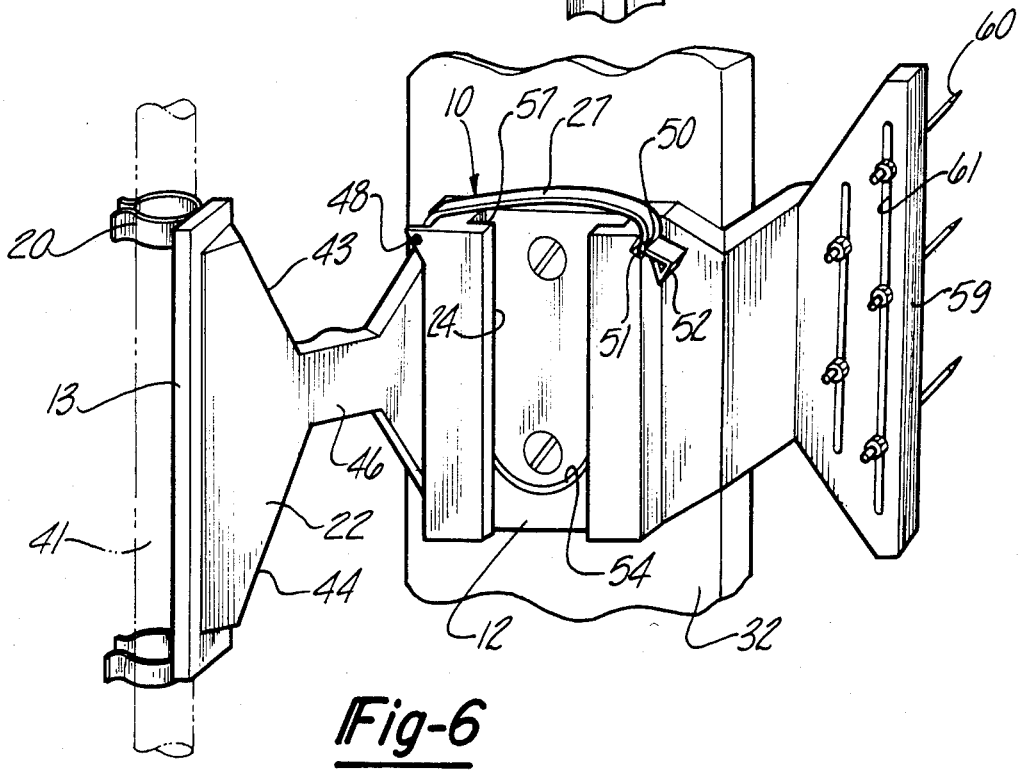
FIG. 6 is a fragmentary perspective view showing the mounting plate with the auxiliary arrow holder apparatus and an integral bow sight as it is attached to the bow riser.

Referring now to FIGS. 4 and 6, the arm 22 interconnecting the mounting plate 12 and the arrow support bracket 13, is shown in greater detail. The top edge 43 and bottom edge 44 of the arm 22 converge as it extends from the mounting plate 12 to a central portion 46 of the arm 22. The top and bottom edges 43 and 44 then diverge as the arm extends from the central portion 46 to the arrow support bracket 13. The arm 22 is configured to provide an acceptable weight distribution and to minimize any interference with hunting such as is caused by conventional quiver when left attached to the bow. The structure of the arm also reduces the transmission of vibration from the bow to the single arrow caused by the release of an arrow from the bow. The single arrow 41 is conveniently located near the hunter's shooting hand to permit the hunter to quickly grasp it with a minimum of movement, noiselessly, and quickly. The broad areas of attachment of the arm 22 to the mounting plate 12 and arrow support bracket 13 make the construction durable while the reduced thickness of the central portion 46 minimizes any obstruction of the hunter's vision.

Figure 5:
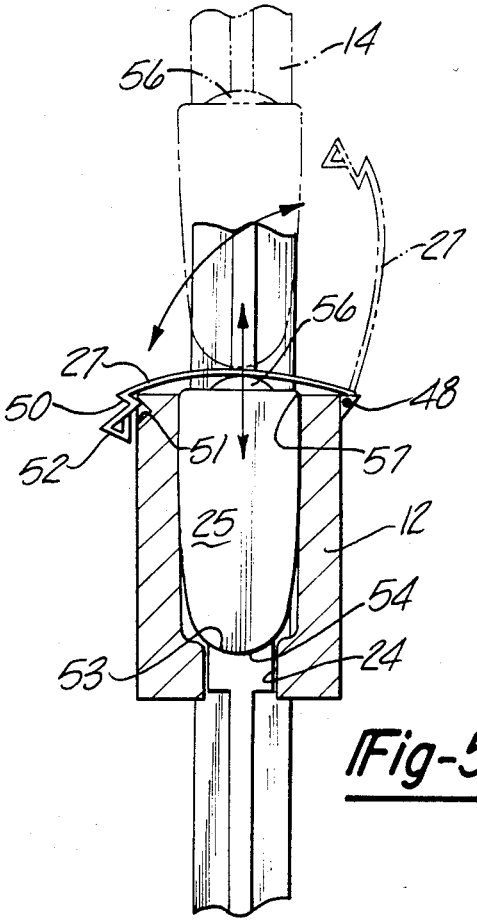
FIG. 5 is a fragmentary cross section diagramatic view taken along the line 5—5 in FIG. 4 showing the operation of the detachable quiver mounting means and the relative movement of the T-shaped extension relative to the T-slot formed in the mounting plate.

The latch clip 27, as shown in FIGS. 5 and 6, is used to hold the detachable quiver 14 in the mounting plate 12. The latch clip 27 is secured to the mounting plate 12 on one side of the T-slot 24 by means of a pivot pin 48. The other end of the latch clip 27 includes a lip 50 for engaging a groove 51 formed in the mounting plate 12 on the other side of the T-slot 24. To remove the quiver 14 from the mounting plate 12 the finger tab 52 is lifted by the hunter to disengage the lip 50 from the groove 51 and the latch clip 27 is pivoted upwardly to the position shown in phantom lines in FIG. 5. The quiver 14 is then moved with a relative sliding motion to detach it from the mounting plate 12. The quiver is re-inserted by reversing the above steps and by pivoting the latch clip 27 until the lip 50 engages the groove 51.

The T-extension 25 features a rounded end 53 on the lower most end thereof. The T-slot 24 has a rounded lower end 54 which is complementary in shape to the rounded end 53 of the T-shaped extension 25. Preferably the general shape of the rounded end 53 of the T-shaped extension 25 and the rounded lower end 54 of the T-slot 24 are parabolic in shape to facilitate insertion and extraction of the quiver 14 in the mounting plate 12 because the rounded end acts as a lead in surface. The complementary shape of the end 53 and the lower end 54 assures a close fit there between.

The upper end of the T-shaped extension 56 extends slightly above the open end 57 of the T-slot 24. The latch clip 27 bears upon the upper end 56 of the T-shaped extension 25 to hold the rounded end 53 of the T-shaped extension firmly in engagement with the rounded lower end 54 of the T-slot 24.

Figure 7:
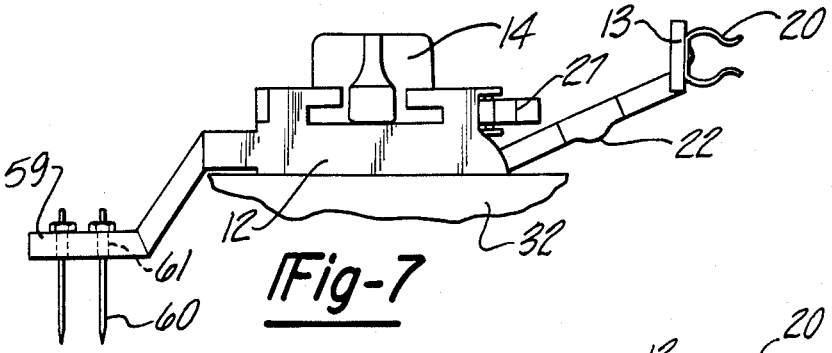
FIG. 7 is a plan view of the mounting plate with the auxiliary arrow holder apparatus and an integral bow sight as it is attached to the bow riser.
Figure 8:
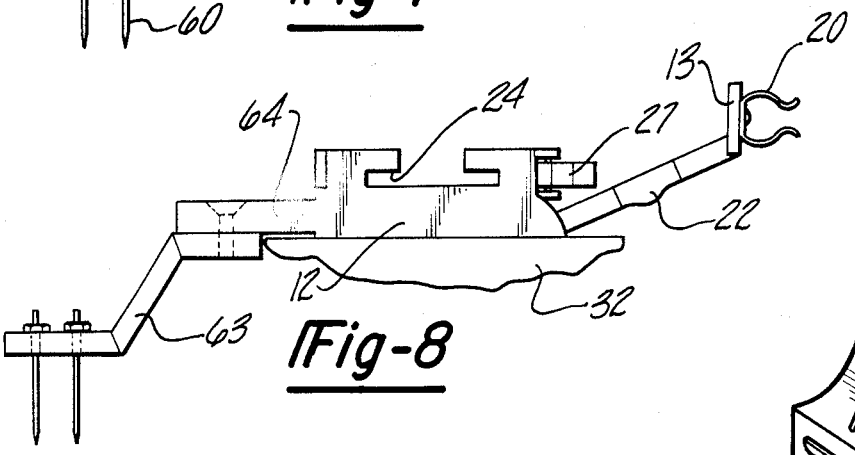
FIG. 8 is a plan view of the mounting plate with the auxiliary arrow holder apparatus and a removable bow sight as it is attached to the bow riser.

Referring now to FIGS. 6, 7, and 8, different embodiments of the auxiliary arrow holder apparatus 10 including a sight 59 are shown. The sight 59, as shown in FIG. 6, is integrally formed with the mounting plate 12 to extend from the opposite side of the mounting plate 12 from the arm 22. The sight 59 extends in front of the bow riser 32. Sight pins 60 are then attached to the slots 61 formed in the sight 59 at locations corresponding to different distance ranges encountered in hunting.

Referring now to FIG. 8, a detachable sight 63 is shown attached to an extension 64 formed to extend from the opposite side of the mounting plate 12 from the arm 22. The detachable sight 63 offers the advantage of permitting a hunter to use or remove the sight 59. The sight pins 60 may be placed in the slots 61 at the desired location and do not require resetting or readjustment when the detachable sight 63 is removed and replaced on the extension 64.

Figure 9:
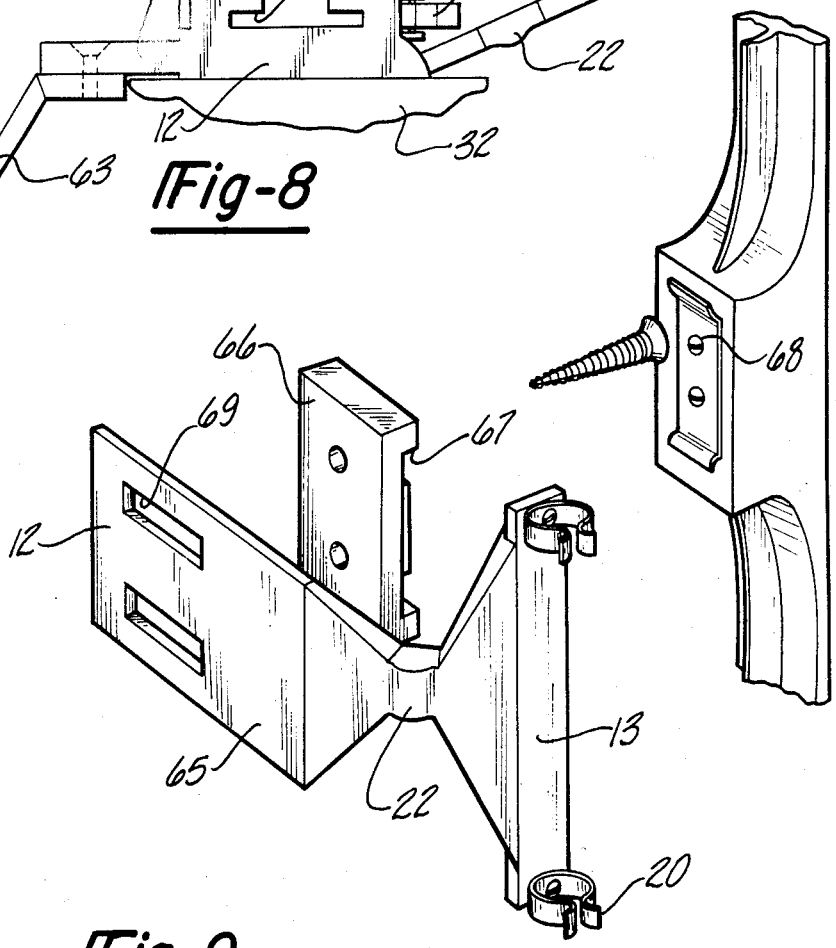
FIG. 9 is an exploded perspective view of the retrofit auxiliary arrow holder apparatus as it is intended to be assembled with a detachable bow quiver and mounting bracket.

Referring now to FIG. 9, a retrofit auxiliary arrow holder apparatus 65 is shown which is intended to be used with conventional detachable quivers. The retrofit apparatus 65 includes a mounting plate 12 which is adapted to be attached to the bow riser of a bow by positioning the mounting plate 12 between the bow riser and the prior art type mounting plate 66. The two part bracket 67 and 68 of prior art detachable quiver may then be attached and detached from the prior art mounting plate 66 while the retrofit apparatus 65 remains unaffected. In this way the advantages of the present invention may be incorporated substantially into conventinal detachable quiver assemblies. The slotted openings 69 and the mounting plate 12 of the retrofit apparatus 65 are helpful in making the retrofit apparatus 65 usable with most types of detachable quivers.

It is to be understood that the invention has been described in conjunction with several specific embodiments thereof, however, many alternatives, modifications, and variations will be apparent to those skilled in the art in light of the foregoing description. Accordingly, all alternatives, modifications, and variations are intended to be embraced within the scope of the appended claims.

What is claimed is:

1. An auxiliary arrow holder for an archery bow comprising:
   - a mounting plate;
   - first means for securing said mounting plate to the archery bow;
   - second means attached to said mounting plate for retaining a single arrow on said bow in parallel spaced relationship to the bow, said second means including an arm extending from said plate having converging top and bottom edges extending from the opposite ends of the mounting plate to a central portion and said top and bottom edges diverging from said central portion to an arrow support bracket having two vertically aligned spring clips for detachably holding the single arrow.

2. The auxiliary arrow holder apparatus of claim 1 wherein third means is formed on the opposite side of said mounting plate from said bow for attaching a detachable quiver to the bow.

3. The auxiliary arrow holder apparatus of claim 2 wherein said third means comprises a T-slot formed in said mounting plate open on the top end and the lower end; and said quiver including a complementary T-shaped extension adapted to be received in said T-slot in a relative sliding arrangement.

4. The auxiliary arrow holder of claim 3 wherein the complementary T-shaped extension features a rounded end of the lower end thereof to facilitate alignment of the quiver with the T-slot; and said T-slot includes a complementary rounded lower end for receiving the T-shaped extension securely therein.

5. The auxiliary arrow holder of claim 4 wherein said rounded end of the T-shaped extension is substantially parabolic in shape and the complementary rounded lower end of the T-slot is likewise substantially parabolic in shape.

6. The auxiliary arrow holder apparatus of claim 3 wherein a latch clip is pivotally connected to one side of said T-slot formed on the mounting plate, said latch clip being adapted to extend across the open end of the T-slot and including means for gripping the mounting plate on the other side of the T-slot and clamping the upper end of the T-shaped extension.

7. The auxiliary arrow holder apparatus of claim 6 wherein said gripping means further comprises a reversely turned lip formed on the end of the spring clip, and a groove formed in the mounting plate, said groove being adapted to receive the lip of the latch clip.

8. The auxiliary arrow holder apparatus of claim 1 wherein a sight is integrally formed to extend from the opposite side of the mounting plate from the second means and extending forward of the bow to permit sight pins to be attached to the sight for use in hunting.

9. The auxiliary arrow holder apparatus of claim 1 wherein a sight is detachably attached to the opposite side of the mounting plate from the second means to provide a detachable sight for use with the auxiliary arrow holder apparatus.

10. The combination of a quiver and an auxiliary arrow holder for use with an archery bow comprising:
   - a plate being adapted to be secured to the archery bow;
   - first and second means formed on the plate and the quiver for detachably securing the bow quiver to said plate;
   - an arm extending from said plate independently of the quiver, said arm having a broad area of attachment to the mounting plate, a central portion having a reduced thickness for reducing visual obstruction about said central portion, and a broad area of attachment to an arrow support bracket having a third means for detachably retaining a single arrow independently of the quiver.

11. The auxiliary arrow holder apparatus of claim 10 wherein said first and second means further comprise:
   - a T-slot formed in said mounting plate open on the top end and the lower end; and
   - a complementary T-shaped extension on the quiver and being adapted to be received in said T-slot in a relative sliding arrangement.

12. The auxiliary arrow holder of claim 11 wherein the complementary T-shaped extension features a rounded end on the lower end thereof to facilitate alignment of the quiver with the T-slot; and said T-slot includes a complementary rounded lower end for receiving the T-shaped extension securely therein.

13. The auxiliary arrow holder of claim 12 wherein said rounded end of the T-shaped extension is substantially parabolic in shape and the complementary rounded lower end of the T-slot is likewise substantially parabolic in shape.

14. The auxiliary arrow holder apparatus of claim 11 wherein a latch clip is pivotally connected to one side of said T-slot formed on the mounting plate, said latch clip being adapted to extend across the open end of the T-slot and including means for gripping the mounting plate on the other side of the T-shaped extension.

15. The auxiliary arrow holder apparatus of claim 14 wherein said gripping means further comprises a reversely turned lip formed on the end of the spring clip, and a groove formed in the mounting plate, said groove being adapted to receive the lip of the latch clip.

16. The auxiliary arrow holder apparatus of claim 10 wherein a sight is integrally formed to extend from the opposite side of the mounting plate from the arm and extending forward of the bow to permit sight pins to be attached to the sight for use in hunting.

17. The auxiliary arrow holder apparatus of claim 10 wherein a sight is detachably attached to an extension formed on the opposite side of the mounting plate from the arm to provide a detachable sight for use with the auxiliary arrow holder apparatus.

18. In the combination of claim 10, wherein a retrofit auxiliary arrow holder is provided and the archery bow has a bow string:

said plate having first and second oppositely oriented planar sides and a third side facing the bow string, said third side extending between the first and second sides;

said first side being adapted to be secured to said archery bow;

said quiver having a mounting bracket and means for connecting said bracket to said bow;

said second side of said plate being adapted to engage said mounting bracket wherein said mounting bracket is connected to said bow through said plate;

said arrow support bracket being disposed between the quiver and the bow string and being spaced and distinct from said plate;

third means disposed on said arrow support bracket for detachably retaining a single arrow independently of said quiver; and said arm being elongate and attached on one end contiguous with the third side of said plate and extending away from said plate to the arrow support bracket, said elongate arm along its length being distinct from said plate, whereby an extra arrow may be retained on the bow entirely independent of the quiver and the quiver mounting basket.

* * * * *